United States Patent [19]

Eskelinen

[11] Patent Number: 4,536,970

[45] Date of Patent: Aug. 27, 1985

[54] PROCEDURE FOR BOOSTING THE VENTILATION IN THE HOOD OF A PAPER MACHINE

[75] Inventor: Pekka Eskelinen, Turku, Finland

[73] Assignee: Valmet Oy, Finland

[21] Appl. No.: 557,186

[22] PCT Filed: Mar. 16, 1983

[86] PCT No.: PCT/FI83/00026

§ 371 Date: Nov. 14, 1983

§ 102(e) Date: Nov. 14, 1983

[87] PCT Pub. No.: WO83/03269

PCT Pub. Date: Sep. 29, 1983

[30] Foreign Application Priority Data

Mar. 18, 1982 [FI] Finland ..... 820935

[51] Int. Cl.[3] ..... F26B 3/24

[52] U.S. Cl. ..... 34/41; 34/35; 34/86; 34/201; 34/113

[58] Field of Search ..... 34/114, 122, 35, 86, 34/48, 54, 155, 41, 201, 113

[56] References Cited

U.S. PATENT DOCUMENTS 2,931,107 4/1960 Sellers ..... 34/114
3,434,224 3/1969 Blomgren et al. ..... 34/114
4,137,646 2/1979 Fuhring ..... 34/75

FOREIGN PATENT DOCUMENTS 2654835 8/1978 Fed. Rep. of Germany .
359874 10/1973 Sweden .

*Primary Examiner*—Larry I. Schwartz
*Attorney, Agent, or Firm*—Steinberg & Raskin

[57] ABSTRACT

A procedure for boosting the ventilation in drying sections of paper machines provided with a closed hood (1). In the procedure, air is blown on such surfaces which are susceptible to condensate precipitation. Air jets ($F_1$,$F_2$) are blown mainly obliquely downward through air ducts (11A,11B) disposed adjacent to both side walls (7A,7B) of the hood (1), above all towards the inner surfaces of the door, hatch and/or window structures (12A,12B,16,17) in association with the lower part of the walls (7A,7B) of the hood (1). The blowing air is taken to the air ducts (11A,11B) from the air within the hood (1) or as a mixture of air within the hood (1) and of dry replacement air. For air ducts (11A,11B) are used horizontal air ducts (11A,11B) extending the length of the hood (1) and on which have been disposed blowing nozzles (8A,8B), of which the blowing direction is obliquely towards the inner surfaces of doors (12A,12B) or equivalent of the hood (1) adjacent to them or below them.

12 Claims, 6 Drawing Figures

PROCEDURE FOR BOOSTING THE VENTILATION IN THE HOOD OF A PAPER MACHINE

BACKGROUND OF THE INVENTION

The present invention concerns a procedure for boosting the ventilation in paper machine drying sections with closed hood, the procedure involving blowing onto surfaces suspectible to condensate precipitation, air which is in an appropriate state.

In a modern paper machine, the primary heat consumption is almost entirely incurred in the drying section. The specific primary thermal consumption in the drying process per unit of water evaporated is dependent on the humidity of the exhaust air.

Endeavours have all the time been directed to increasing the humidity of the exhaust air from the paper machine hood. In the case of open hoods, the humidity of the exhaust air was 50–80 g per kg of dry air. With closed hoods the value of 100 g per kg of dry air was reached in the 1960's, and this was brought up to 120 g per kg of dry air in the 1970's. The dimensioning value used for the exhaust air has been 130–140 g per kg of dry air in recent years.

The obstacle to raising the humidity past 150 g per kg dry air is precipitation of so-called condensate, or condensation of water vapour, on the hood structures. This phenomenon occurs when the surface temperature of the structure is lower than the dew-point of the air in respective state. Condensation is a highly detrimental phenomenon in the hood for the reasons, among others, of accelerated corrosion of the hood structures and of water drops falling on the paper web.

Various measures have been used in attempts to prevent occurrence of condensation in the hood at high exhaust air humidity. Of such may above all be mentioned improved thermal lagging of the hood. While still in the 1960's the thermal lagging had a thickness about 50 mm, nowadays quite commonly a thickness about 100 mm is already employed. Another measure used towards preventing condensation is to blow dry and hot air within the hood at the points where condensation occurs. This procedure has been disclosed in a paper by the company Svenska Fläktfabriken Ab entitled "Modern Paper Machine Hoods and Pocket Ventilation Systems" delivered at the felt symposium arranged in Halmstad, in July 1981, by Nordiskafilt AB.

However, if it is desired to increase the humidity of the exhaust air from the hood considerably beyond the present, e.g. up to 200 g per kg dry air, condensation can no longer be avoided by increasing the thickness of the hood's thermal lagging.

This is due to frequently high local humidities or to locally low surface temperatures occurring at so-called thermal bridges and points of leakage. The doors and windows of the hood are particularly concerned in this respect. Elimination of thermal bridges and leaks would require such expensive solutions that these cannot be carried out in practice.

Blowing of dry and hot air at the points susceptible to condensation also fails to solve the problems arising from condensation because there simply is not enough air to this purpose, all the air having to be used to increase the evaporation. This is particularly the case when using high exhaust air humidity, because as the humidity level of the air within the hood increases, evaporation is impeded with diminution of the humidity gradient between the surrounding air and the saturated boundary layer upon the evaporative surface, i.e., the web. Moreover, the reduced exhaust air quantity even in itself results in a reduced replacement air quantity, since the replacement air accounts for only about 65–80% of the exhaust air.

In the U.S. Pat. No. 4,268,974 is disclosed a paper machine hood where the frame structure of the hood also serves as a system of air passages. The heat recovery has also been accommodated within the hood. Although in the hood according to U.S. Pat. No. 4,268,974 the temperature can be made so high that no condensation occurs, the condensation of water vapour e.g. at windows and doors still remains unsolved.

SUMMARY OF THE INVENTION

The object is in the present invention to provide a procedure by which said condensation can be prevented even if the humidity of the exhaust air from the hood is up to the order of 200 g per kg of dry air. Furthermore, it is an object to provide a procedure by which the moisture profile of the paper web can be equalized by preventing excessive drying of one or both margins of the web. In order to attain these aims, and others which will become apparent later on, the procedure is mainly characterized in that through air passages disposed in the vicinity of both side walls of said hood are blown, mainly in a downwardly oblique direction, air jets at least partly against the inner surfaces of door, hatch and/or window structures associated with the lower part of the hood's side walls, and that to said air passages the blowing air is taken from the air within the hood, or as a mixture of air within the hood and of dry replacement air.

As is known, in the lower parts of the side walls of a paper machine's hood there are doors, windows or other equivalent covers which have to be opened frequently and in connection with which sealing difficulties tend to occur, and thermal bridges cannot always be avoided. These problems are avoided in a simple manner by means of the procedure of the invention.

The said air jets may also be employed to eject from side spaces of the hood adjacent to them, hot and humid air, and it is hereby possible to increase the humidity and temperature level in the areas of the hood's walkways. It is possible by such increases to reduce the excessive drying of the paper web's margins and to reduce the thermal losses from the ends of the drying cylinders, this contributing to better thermal economy of the drying section.

One possible embodiment of the invention is that in which the procedure is used to equalize the one-sided moisture profile of the paper web by blowing through said air passages more air on that side of the drying cylinders where the web has higher moisture content. On the margin in question is produced by means of air blowing a slight overpressure, which causes an air flow axially across the machine. By this procedure, the web margin on the side of the blowing effect will dry more powerfully than the opposite margin, because as it flows in the pockets across the machine the air is humidified all the time and the skewed drying will be equalized.

BRIEF DESCRIPTION OF THE DRAWINGS

The invention is described in the following in detail with reference to the figures in the attached drawing, there being no intention to confine the invention to the details therein presented.

FIG. 3A showing the hood as viewed from the direction A, and FIG. 3B from direction B, indicated in FIG. 4.

DETAILED DESCRIPTION OF THE PREFERRED EMBODIMENT

Figure 1:
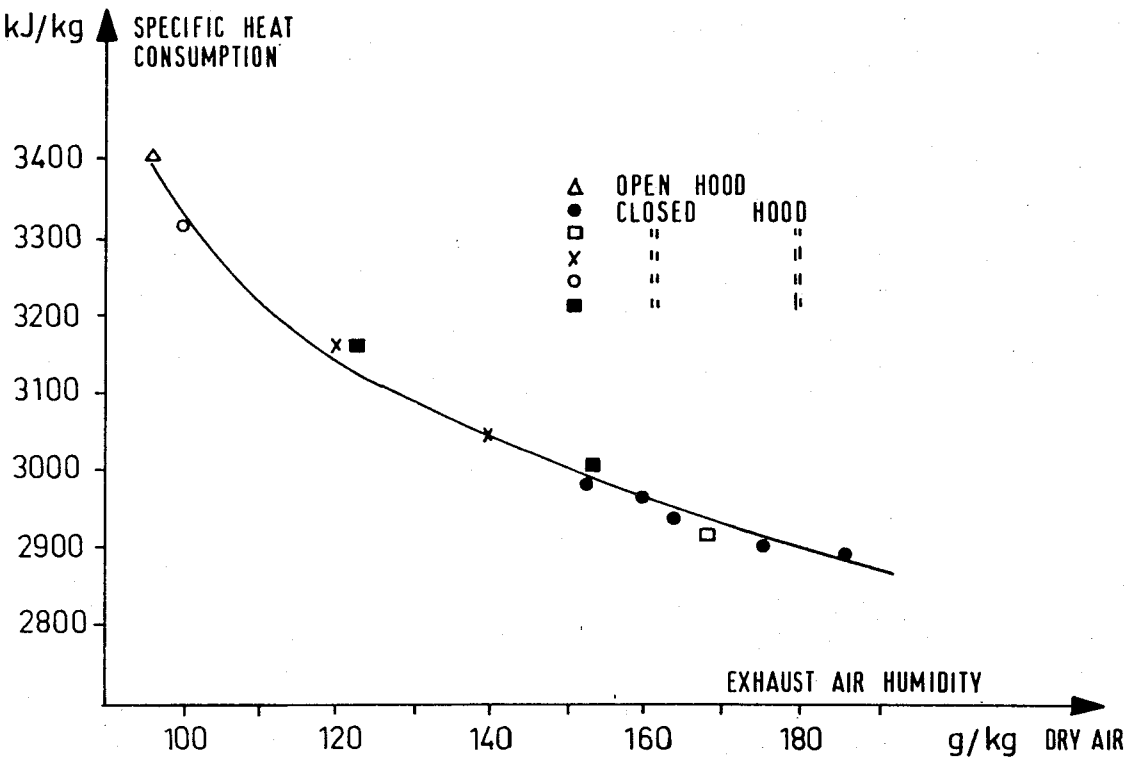
FIG. 1 displays the specific heat consumption of a number of paper machines built in actual practice, plotted over the humidity of the exhaust air.

In FIG. 1 are shown the results of measurements carried out in six different existing paper machines. It is seen that the specific thermal energy consumption decreases with increasing humidity of the exhaust air. This is due to the fact that the air quantity needed for ventilation of the dry section decreases with increasing exhaust air humidity. This implies reduced blower power and less steam required for heating the incoming air. Moreover, the heat recovery operates with higher efficiency when the contribution of so-called wet heat transfer increases.

Figure 3A:
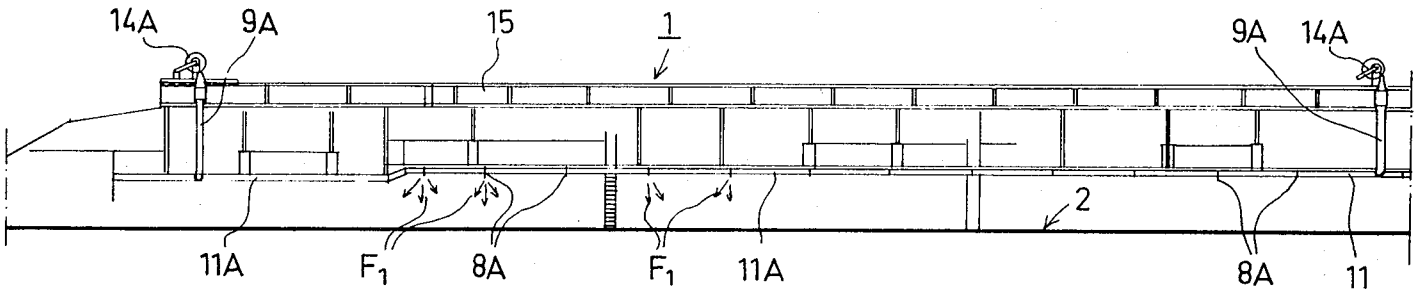
FIGS. 3A and 3B show longitudinal sections of the hood of the drying section of a paper machine hood where the procedure of the invention is being applied.
Figure 3B:
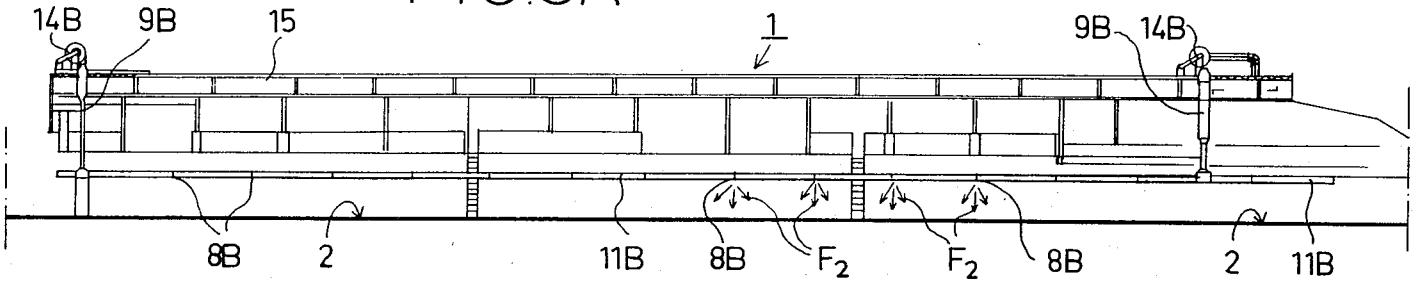
Figure 4:
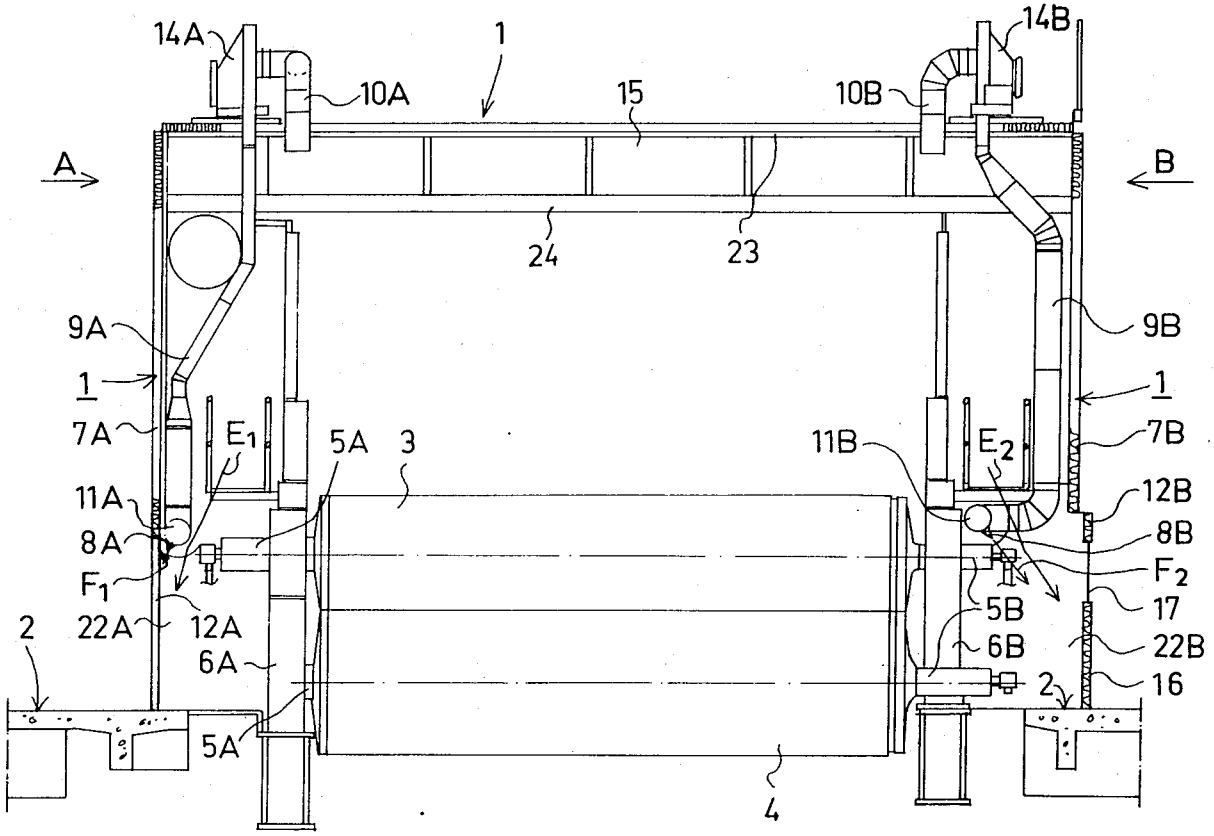
FIG. 4 is a cross section through the hood of the drying section of a paper machine where the procedure of the invention is applied.

In FIGS. 3A,3B and 4 is schematically shown the hood 1 of a paper machine's drying section, this hood consisting of vertical side walls 7A,7B and of a roof 23 and ceiling 24, these two defining between themselves a ceiling interspace 15. The floor level of the paper machine hall has been indicated with reference numeral 2. Above this level 2, the drying cylinders of the paper machine have been carried by their journal pins 5A,5B in the side frames 6A,6B, FIG. 4 showing of them one cylinder 3 in the upper row and one cylinder 4 in the lower row. In the lower part of the side walls 7A of the hood 1 have been provided the doors 12A and 12B of the hood, within which is found the walkway space 22A and 22B of the hood. As shown in FIG. 4, the door 12B below the wall 7B has a window 17. The door 12B is composed of a board structure 16 to be described later on.

Condensation, i.e., precipitation of water vapour occurs in the hood 1 if the structure within the hood 1 have a surface temperature lower than the dew-point of the interior air of the hood. The surface temperature of the inner walls 12,16,17 of the hood 1 can be calculated by the formula.

$$T_{surf} = T_{int} - \frac{k}{\alpha_i}(T_{int} - T_{ext}) \quad \text{(I)}$$

where $T_{int}$=air temperature inside the hood $T_{ext}$=air temperature outside the hood (in the machine hall)

$\alpha_i$=heat transfer coefficient from air to wall inside the hood k=heat transmissivity coefficient.

The heat transmissivity coefficient of a planar surface is calculable by the formula $$k = \left(\frac{1}{\alpha_s} + \sum_{i=1}^{n} \frac{si}{\lambda_i} + \frac{1}{\alpha_u}\right)^{-1} \quad \text{(II)}$$

where $\alpha_j$=heat transfer coefficient from air to wall $\alpha_e$=transfer coefficient from wall to air $s_j$=thickness of material j $\lambda_j$=thermal conductivity of material j.

When the movement of air within the hood adjacent to walls and surfaces is boosted, the heat transfer coefficient $\alpha_i$ from air to wall increases. The thermal transmissivity k also increases (Formula I), though not with equal strength because all the other factors exerting an influence in accordance with formula (I) are unchanged. Hence follows that the surface temperature of the hood's inner wall increases because the term $k/\alpha_i.(T_{int}-T_{ext})$ in the formula (II) of the surface temperature decreases.

Figure 2A:
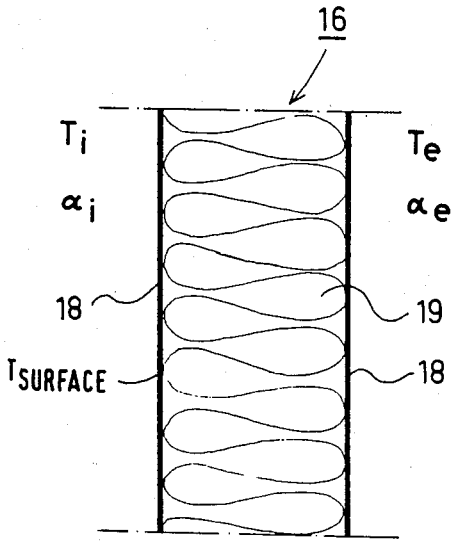
FIGS. 2A and 2B present schematically the cross section of the hood's lagging board, and the heat transmission coefficients of free convection and forced convection.
Figure 2B:
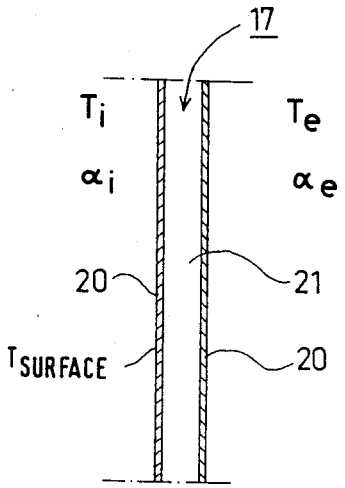

In FIG. 2A is schematically shown a cross section of the lagging board of the hood and, similarly, in FIG. 2B that of a window of the hood. The lagging board 16 carries on both sides an aluminium sheet 18 about 1 mm thick and, inside, as thermal lagging, 100 mm of mineral wood 19. The board structure of FIG. 2A presents a thermal resistance of 0.833 $m^2$ °C. per watt, taking the thermal bridges into account.

The window structure of FIG. 2B has two 3 mm insulating glass panes 20, and a 15 mm air gap 21. This structure 20,21 has air resistance 0.182 $m^2$ °C. per watt.

In Table A below has been calculated, for example, the surface temperature of the hood lagging board of FIG. 2A and in Table B that of the window of FIG. 2B, both for free convection and for forced convection conditions. Free convection is equivalent to the situation in a hood consistent with the present state of art, while forced convection corresponds to the situation in a hood in which the procedure of our invention is applied.

TABLE A

| Wall (FIG. 2A) | | Free convection | Forced convection |
|---|---|---|---|
| $T_s$ | °C. | 75 | 78 |
| $T_u$ | °C. | 22 | 22 |
| $\alpha_s$ | W/$m^2$ °C. | 6.0 | 9.5 |
| $\alpha_u$ | W/$m^2$ °C. | 5.5 | 5.5 |
| k | W/$m^2$ °C. | 0.85 | 0.89 |
| $T_{surface}$ | °C. | 67.5 | 72.8 |

TABLE B

| Window (FIG. 2B) | | Free convection | Forced convection |
|---|---|---|---|
| $T_s$ | °C. | 65 | 70 |
| $T_u$ | °C. | 22 | 22 |
| $\alpha_s$ | W/$m^2$ °C. | 6.0 | 9.5 |
| $\alpha_u$ | W/$m^2$ °C. | 5.5 | 5.5 |
| k | W/$m^2$ °C. | 1.89 | 2.13 |
| $T_{surface}$ | °C. | 51.5 | 59.2 |

In the procedure of the invention, is utilized the above-described increase of surface temperature caused by the air movement. Inside the hood 1, adjacent to its side walls 7A and 7B have been disposed air ducts 11 longitudinal to the hood, located at least at the height of the upper edge of the hood's 1 doors 12A,12B, but preferably somewhat higher up. On the lower margin of the ducts 11A,11B have been disposed nozzles 8A,8B, from which air jets $F_1$,$F_2$ discharge downwards or obliquely downwards. The air in the vicinty of the side walls 7A,7B of the hood 1 moves owing to ejection effect from the jets $F_1$, $F_2$, and the consequence is increase of the surface temperature of the hood's inner walls and reduction of the risk of condensation, on the basis of the physical phenomena above described.

The air blown out from the nozzles 8A,8B in the form of jets $F_1$,$F_2$ is either air from within the hood, which the blower 14 draws from the ceiling interspace 15, or in part air from within the hood 1 and in part dry replacement air.

As can be seen in FIGS. 3A and 3B, the air ducts 11A and 11B extend substantially over the whole length of the hood 1, and in the region of their both ends have been provided vertical ducts 9A,9B. The ducts 9A,9B are connected to blowers 14A,14B, to which the intake air is taken from the ceiling interspace 15 by intake tubes 10A,10B. The said ducts 11A,11B extend substantially horizontally above the doors 12A,12B substantially over the whole length of the hood 1. The ducts 11A and 11B have been provided at suitably short intervals in the manner shown by FIGS. 3A and 3B with said nozzles 8A,8B, so that the effect of the invention is made to extend uniformly enough over the whole length of the hood 1.

It is also possible by the procedure of the invention to improve the moisture profile of the paper. In a typical transversal moisture profile, the web edges are drier than the centre. This is believed at least in part to be due to fairly dry air flowing from the sides of the machine into the pockets defined by the web, the surface of cylinders 3,4 and the drying wires (not depicted). Within the hood 1 on its corridors 22A,22B the humidity of air is only 50–100 g per kg of dry air, while in said pockets the humidity of air is 150–500 g per kg of dry air. In the blowing procedure of the invention, hot and humid air is ejected (Arrows $E_1$ and $E_2$ in FIG. 4) to the level of the corridors 22A,22B from the upper parts of the hood 1, whereby the humidity and temperature level of the corridors 22A,22B increases. This results in lesser over-drying of the paper edges. The heat losses from the ends of the cylinders 3,4 also becomes less, whereby the thermal economy of the machine improves partly owing to this reason. It is also possible by the procedure of the invention to correct a moisture profile where one margin of the web is drier than the other, by blowing more air on one side of the machine, whereby one achieves that air flows in the cross-machine direction. The consequence is that one margin of the web dries more strongly than the other, and the skew moisture profile is corrected.

In the following are presented the claims, various details of the invention being allowed to vary within the scope of the inventive idea thereby defined.

I claim:

1. In a drying section having a closed hood and side wall structures enclosing drying cylinders therewithin, a method for inhibiting condensation on the inner surfaces of the side wall structures, comprising the steps of:

disposing an air duct adjacent to at least one of the side wall structures of the closed drying section, directing an air stream through the air duct, at least a portion of the air stream constituted by air from within the closed drying section, and directing the air stream out from the air duct, substantially obliquely downwardly, and at least partially towards the inner surface of the respective adjacent side wall structure, to inhibit condensation on the inner surface wherein the humidity within the closed drying section is at least about 0.15 kg/kg.

2. The method of claim 1, wherein a door and a window form part of the side wall structures, and wherein the air stream is directed at least partially towards the inner surfaces of the door and window.

3. The method of claim 1, wherein the air duct extends substantially horizontally over substantially the entire length of the closed drying section, and the air stream is directed through nozzles disposed along the air duct and oriented to direct the air stream in the substantially obliquely downwardly direction.

4. The method of claim 3, comprising the additional step of directing humid air from an interior area of the closed drying section to peripheral areas within the same, whereby humidity and temperature level of the peripheral areas is increased.

5. The method of claim 4, wherein over drying of margins of a paper web passing through the closed drying section is inhibited and transverse moisture profile of the running paper web is equalized.

6. The method of claim 5, wherein heat loss from ends of the drying cylinders is reduced, and thermal efficiency of the drying section is improved.

7. The method of claim 4, comprising the additional steps of disposing two air ducts adjacent respective side wall structures of the closed drying section and having respective nozzles, and directing an air stream through each respective air duct.

8. The method of claim 7, comprising the additional step of directing the air stream through a duct adjacent a margin of a paper web passing through the closed drying section having a higher moisture content than the opposite margin thereof, at a higher rate than the air stream directed through the opposite air duct, whereby the margin of the running paper web having the higher moisture content is more strongly dried than the opposite margin, to even out any skewed moisture profile within the web.

9. The method of claim 7, comprising the additional steps of disposing substantially vertical ducts in communication with the respective substantially horizontal air ducts, and inspiring air from an upper area of the closed drying section adjacent the hood thereof, through the substantially vertical air ducts and into the respective substantially horizontal air ducts.

10. The method of claim 9, wherein the closed drying section comprises a ceiling, and a spacing between the ceiling and the closed hood thereof, with the air being inspired from within the spacing into the substantially vertical air ducts.

11. The method of claim 6, wherein humidity of the air within the closed drying section is increased up to the order of about 0.20 kg/kg of dry air.

12. The method of claim 1, wherein the air stream is entirely constituted by air from within the closed drying section.

* * * * *